US007541741B2

(12) United States Patent
An

(10) Patent No.: US 7,541,741 B2
(45) Date of Patent: Jun. 2, 2009

(54) PLASMA DISPLAY PANEL WITH SUSTAIN ELECTRODES ACCOMMODATING BRIGHTNESS

(75) Inventor: Jae-Young An, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 336 days.

(21) Appl. No.: 11/505,354

(22) Filed: Aug. 17, 2006

(65) Prior Publication Data

US 2007/0040498 A1 Feb. 22, 2007

(30) Foreign Application Priority Data

Aug. 18, 2005 (KR) ..... 10-2005-0075660

(51) Int. Cl.
*H01J 17/49* (2006.01)

(52) U.S. Cl. ..... 313/582

(58) Field of Classification Search ..... 313/582–587
See application file for complete search history.

(56) References Cited

U.S. PATENT DOCUMENTS

| | | | | |
|---|---|---|---|---|
| 6,261,862 | B1 * | 7/2001 | Hori et al. | 438/96 |
| 6,335,592 | B1 | 1/2002 | Jang et al. | |
| 6,348,762 | B1 | 2/2002 | Nunomura et al. | |
| 6,452,333 | B1 * | 9/2002 | Torisaki et al. | 313/586 |
| 2004/0041522 | A1 * | 3/2004 | Takada et al. | 313/586 |
| 2005/0212430 | A1 | 9/2005 | Ahn et al. | |
| 2006/0284546 | A1 * | 12/2006 | Kim | 313/500 |
| 2007/0029908 | A1 | 2/2007 | Goto et al. | |

FOREIGN PATENT DOCUMENTS

| | | | |
|---|---|---|---|
| CN | 1 622 259 | | 6/2005 |
| EP | 1 030 340 | A2 | 8/2000 |
| EP | 1 041 600 | A1 | 10/2000 |
| KR | 2003024887 | A * | 3/2003 |
| WO | WO 2005/043577 | A1 | 5/2005 |

OTHER PUBLICATIONS

Rosen et al; Application of carbon nanotubes as electrodes in gas discharge tubes; Mar. 27, 2000; Applied Physics Letters; vol. 76, Issue 13, pp. 1668-1670.*

* cited by examiner

*Primary Examiner*—Toan Ton
*Assistant Examiner*—Hana A Sanei
(74) *Attorney, Agent, or Firm*—Lee & Morse, P.C.

(57) ABSTRACT

A plasma display panel includes a first substrate, a second substrate separated from the first substrate by a predetermined distance, a plurality of discharge cells in which a discharge occurs, the discharge cells being between the first and second substrate, and a plurality of pairs of sustain electrodes disposed between the first substrate and the second substrate and generating a discharge, wherein each sustain electrode includes a plurality of electrode portions and connection portions electrically connecting the electrode portions, and line widths of the connection portions corresponding to the discharge cells having the highest brightness among the red, green, and blue discharge cells are smaller than line widths of the connection portions corresponding to other discharge cells.

19 Claims, 4 Drawing Sheets

PLASMA DISPLAY PANEL WITH SUSTAIN ELECTRODES ACCOMMODATING BRIGHTNESS

BACKGROUND OF THE INVENTION

1. Field of the Invention

The present invention relates to a plasma display panel (PDP). More particularly, the present invention relates to a PDP that improves brightness, reduces manufacturing defects and can be easily manufactured.

2. Description of the Related Art

Plasma display panels (PDP) have recently replaced conventional cathode ray tube (CRT) as display devices. In a PDP, a discharge gas is sealed between two substrates, a plurality of discharge electrodes are provided between the two substrates, a discharge voltage is applied thereto, phosphor between the two substrates in a predetermined pattern is excited by ultraviolet (UV) light generated by the discharge gas in response to the discharge voltage, thereby displaying a desired image.

Referring to FIG. 1, a conventional alternating current (AC) PDP 10 may include an upper panel 50 that displays images, and a lower panel 60 parallel with the upper panel 50. A plurality of pairs of sustain electrodes 12, each pair having an X-electrode 31 and a Y-electrode 32, may be disposed on a front substrate 11 of the upper panel 50. A plurality of address electrodes 22 may be disposed on a rear substrate 21 of the lower panel 60, the rear substrate 21 being opposite a surface of the front substrate 11 on which the pairs of sustain electrodes 12 are disposed, to cross the X-electrode 31 and the Y-electrode 32 of the front substrate 11. A first dielectric layer 15 and a second dielectric layer 25 may be formed on the front substrate 11 on which the pairs of sustain electrodes 12 are disposed, and the rear substrate 21 on which the address electrodes 22 are disposed, respectively. A protective layer 16, e.g., a MgO layer, may be on a rear surface of the first dielectric layer 15. Barrier ribs 30 that maintain a discharge separation, and prevent electrical and optical cross-talk between discharge cells, may be formed on a front surface of the second dielectric layer 25. Red, green, and blue phosphor layers 26 may be coated on both sides of each of the barrier ribs 30 and on a front surface of the first dielectric layer 25 on which the barrier ribs 30 are not formed.

Each of the X-electrode 31 and the Y-electrode 32 may include transparent electrodes 31*a* and 32*a* and bus electrodes 31*b* and 32*b*. A space formed by a pair of the X-electrode 31 and the Y-electrode 32, and the address electrodes 22 that cross the pair of the X-electrode 31 and the Y-electrode 32, may define a unit discharge cell 70 that forms one discharge portion. Transparent electrodes 31*a* and 32*a* may be formed of a transparent material, e.g., indium tin oxide (ITO), that is a conductor causing discharge and transmitting light emitted from the phosphor layers 26. However, such transparent conductors typically have a large resistance. Thus, when discharge sustain electrodes are formed using only transparent electrodes, a large voltage drop may occur in a lengthwise direction of the discharge sustain electrodes 12, increasing driving power and reducing response speed. To solve the problem, bus electrodes 31*b* and 32*b*, made of a metallic material and having small line widths, may be disposed on the transparent electrodes 31*a* and 32*a*.

However, transparent electrodes 31*a* and 32*a* are expensive, and separate formation of the bus electrodes 31*b* and 32*b* and the transparent electrodes 31*a* and 32*a*, respectively, are required. Thus, cost and manufacturing time increases.

To solve the problem, methods of forming sustain electrodes by using only bus electrodes that are parallel to one another have been developed. However, when the sustain electrodes are formed by using only the bus electrodes, brightness is not high.

SUMMARY OF THE INVENTION

The present invention is therefore directed to a plasma display panel (PDP), which substantially overcomes one or more of the problems due to the limitations and disadvantages of the related art.

It is therefore a feature of an embodiment of the present invention to provide a PDP that may be easily manufactured.

It is therefore another feature of an embodiment of the present invention to provide a PDP that reduces manufacturing defects.

It is yet another feature of an embodiment of the present invention to provide a PDP having improved brightness.

At least one of the above and other features and advantages of the present invention may be realized by providing a PDP including a first substrate, a second substrate separated from the first substrate by a predetermined distance, a plurality of discharge cells in which a discharge occurs, the plurality of discharge cells being between the first and second substrates, and a plurality of pairs of sustain electrodes disposed between the first substrate and the second substrate, the pairs of sustain electrodes generating a discharge therebetween, wherein each sustain electrode includes a plurality of electrode portions and connection portions electrically connecting the electrode portions, and line widths of the connection portions corresponding to discharge cells having a highest brightness among the discharge cells being smaller than line widths of the connection portions corresponding to other discharge cells.

The plurality of discharge cells may include red, green and blue discharge cells, and line widths of the connection portions corresponding to the green discharge cells may be smaller than the line widths of the connection portions corresponding to the red and blue discharge cells. The line widths of the connection portions corresponding to the blue discharge cells may be substantially the same as the line widths of the connection portions corresponding to the red discharge cells.

The line widths of the connection portions may be about 20-60 μm. The line widths of the connection portions corresponding to the discharge cells having the highest brightness may be about 20-35 μm, and the line widths of the connection portions corresponding to other discharge cells maybe about 35-60 μm. The electrode portions of each sustain electrode may have substantially the same line widths. The line widths of the connection portions may be smaller than the line widths of the electrode portions. The line widths of the electrode portions may be about 20-150 μm.

Each connection portion of a sustain electrode may correspond to one of the discharge cells. Each connection portion may be in a center of each discharge cell.

The electrode portions of each sustain electrode may be parallel to one another. Each sustain electrode may include between two and four electrode portions that extend in one direction. The connection portions and the electrode portions may be perpendicular to each other.

The connection portions and the electrode portions of each sustain electrode may be integrated into a single unit. The sustain electrodes may include a conductive metallic material, e.g., Ag, Pt, Pd, Ni, and/or Cu, a conductive ceramic material, e.g., indium doped tin oxide (ITO) and/or antimony doped tin oxide (ATO), or may include carbon nanotubes (CNTs).

The PDP may further include light absorption layers adjacent discharge cells and extending parallel to the plurality of sustain electrode pairs, the light absorption layers may be made of a same material as the sustain electrodes.

At least one of the above and other features and advantages of the present invention may be realized by providing a method of forming a plasma display panel, the method including providing a first substrate, providing a second substrate separated from the first substrate by a predetermined distance, providing a plurality of discharge cells in which a discharge occurs between the first and second substrates, and forming a plurality of pairs of sustain electrodes disposed between the first substrate and the second substrate, forming each sustain electrode including forming a plurality of electrode portions and connection portions electrically connecting the electrode portions, line widths of the connection portions corresponding to discharge cells having a highest brightness among the discharge cells being smaller than line widths of the connection portions corresponding to other discharge cells.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
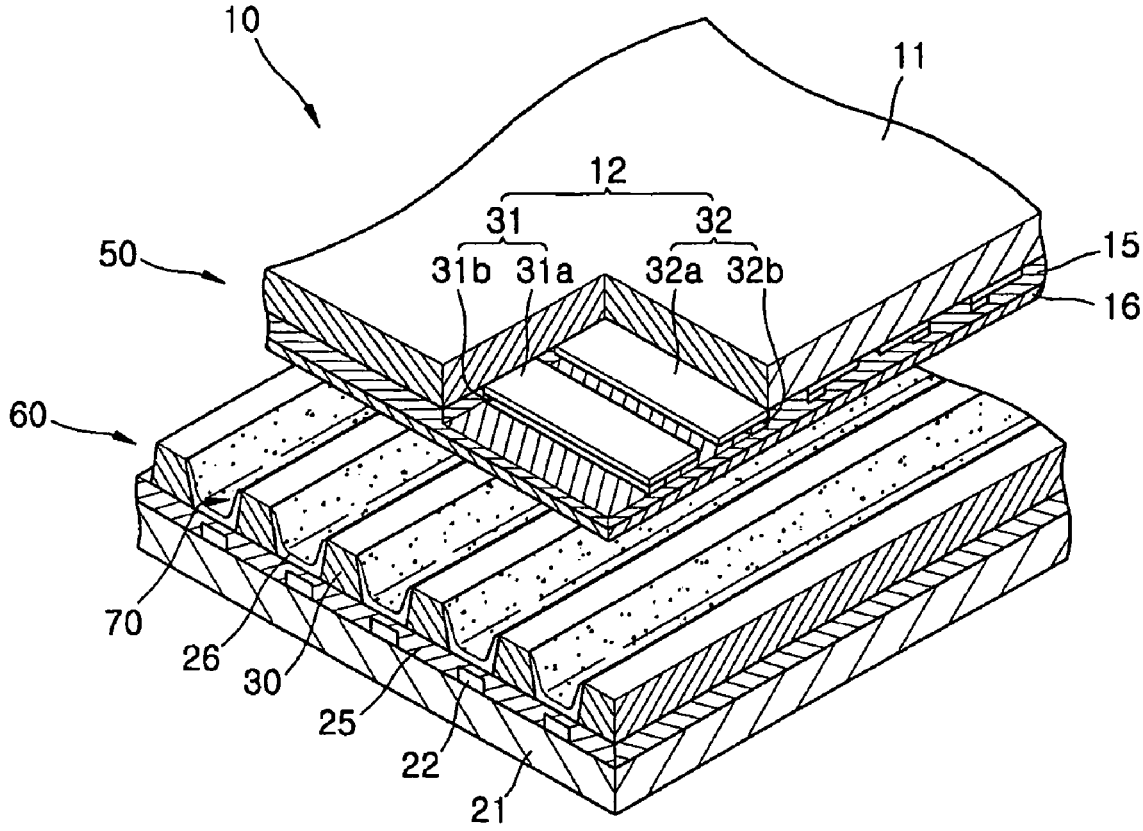
FIG. 1 (CONVENTIONAL ART)
FIG. 1 illustrates an exploded perspective view of a conventional plasma display panel (PDP)

Korean Patent Application No. 10-2005-0075660, filed on Aug. 18, 2005, in the Korean Intellectual Property Office, and entitled: "Plasma Display Panel," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. It will also be understood that the term "phosphor" is intended to generally refer to a material that can generate visible light upon excitation by ultraviolet light that impinges thereon, and is not intended be limited to materials the undergo light emission through any particular mechanism or over any particular time frame. Like reference numerals refer to like elements throughout.

Figure 2:
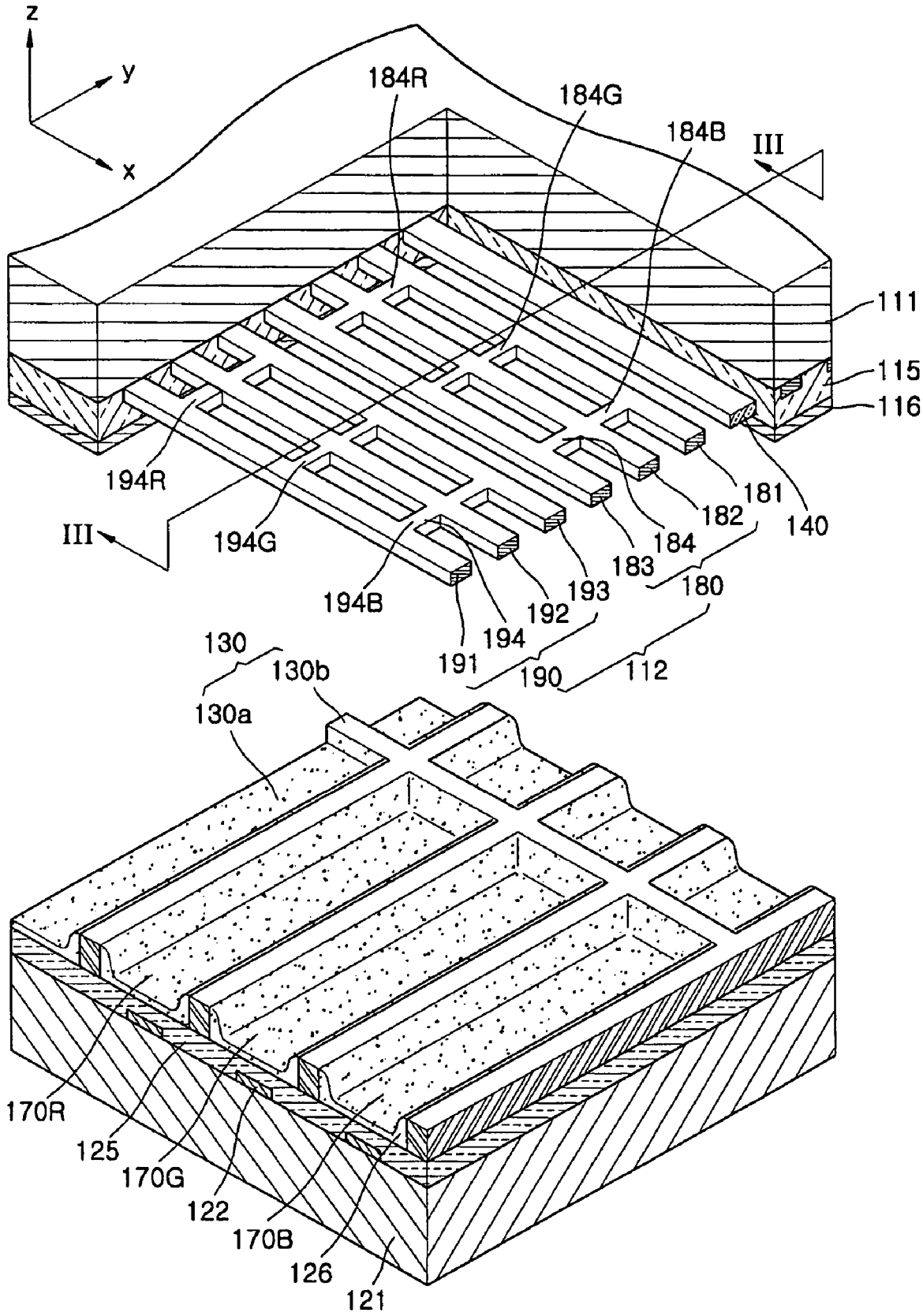
FIG. 2 illustrates a partially cutaway and exploded perspective view of a PDP according to an embodiment of the present invention.
Figure 3:
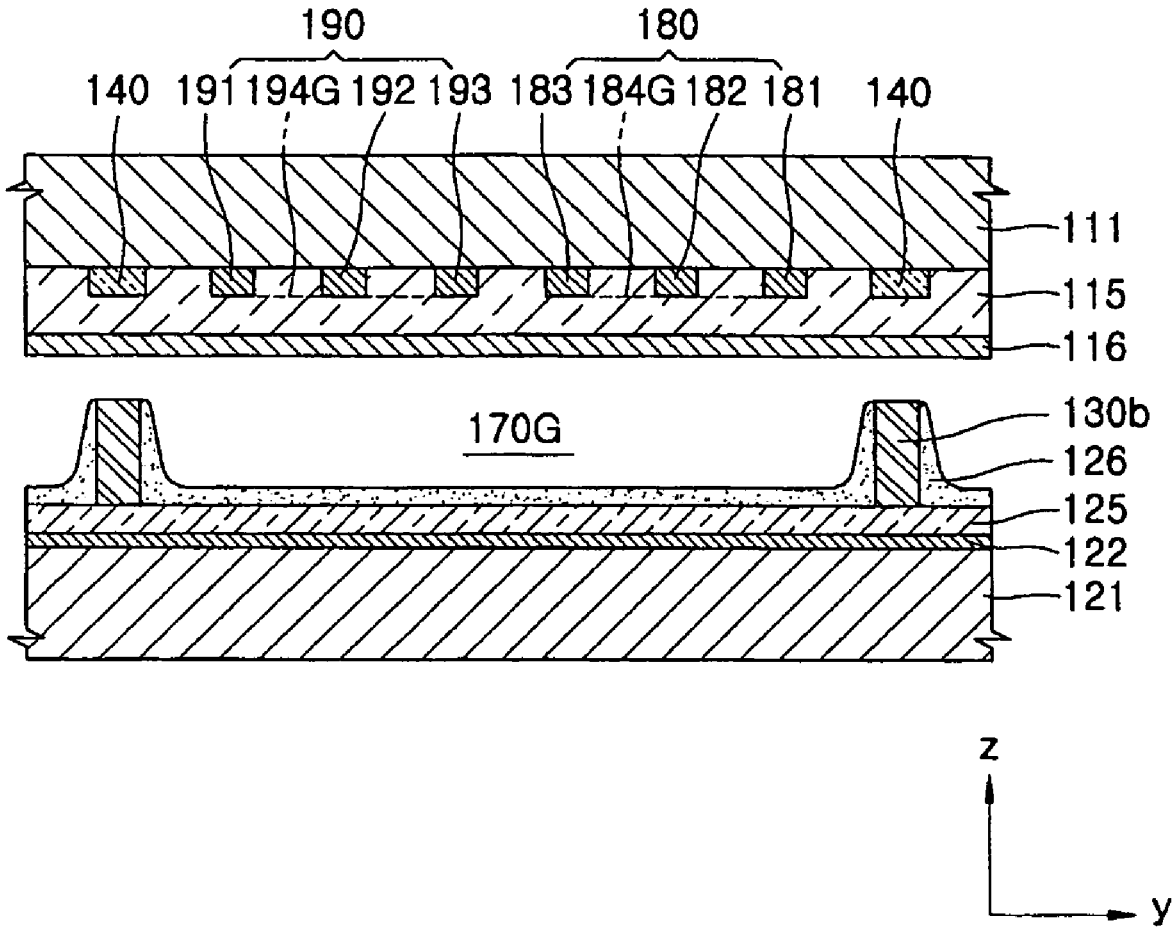
FIG. 3 illustrates a cross-sectional view taken along line III-III of FIG. 2.
Figure 4:
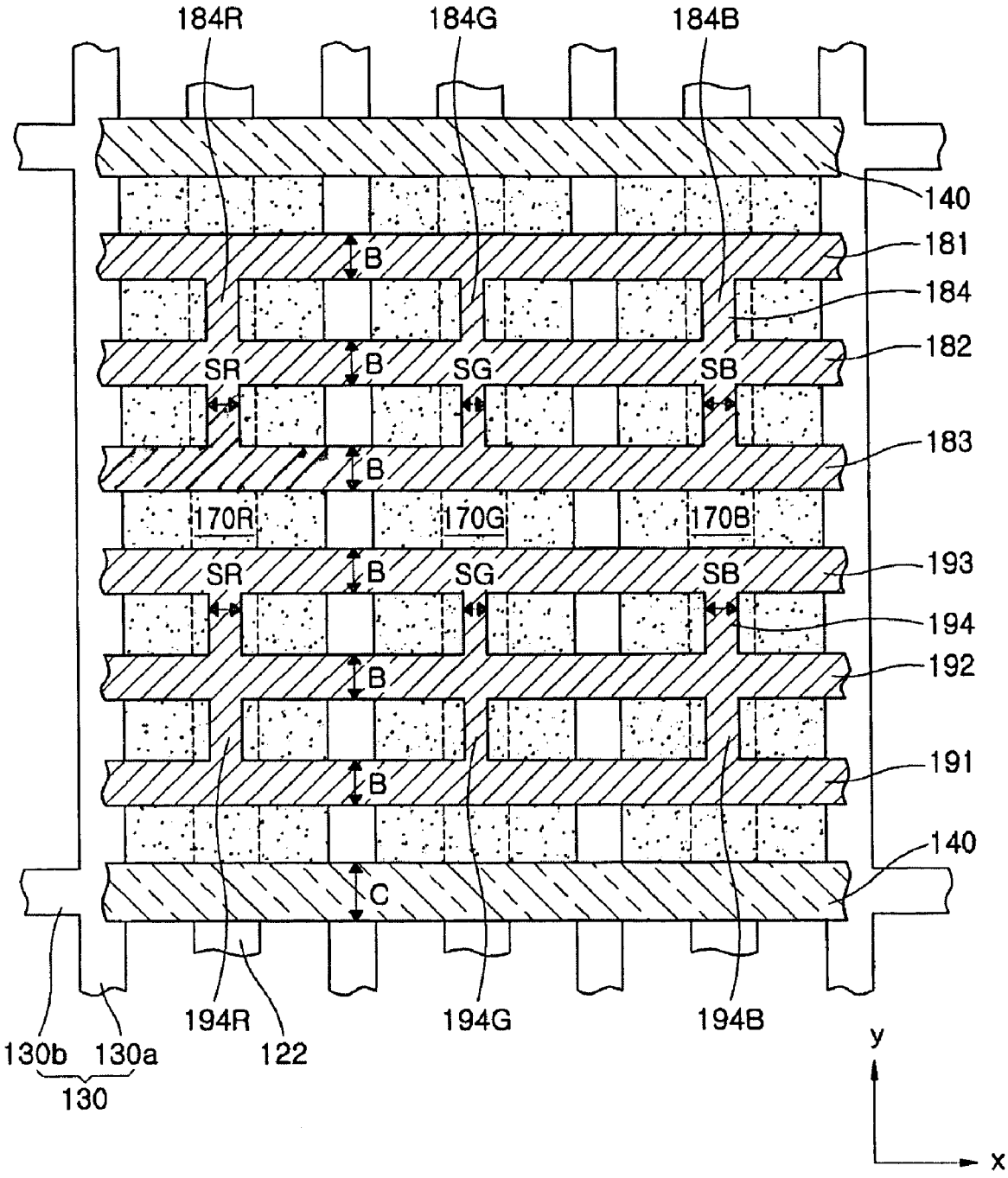
FIG. 4 illustrates a plan view of discharge cells and sustain electrodes illustrated in FIG. 2.

An alternating current (AC) plasma display panel (PDP) 100 according to an embodiment of the present invention is shown in FIGS. 2 through 4. FIG. 2 illustrates a partially cutaway and exploded perspective view of the PDP 100, FIG. 3 illustrates a cross-sectional view taken along line III-III of FIG. 2, and FIG. 4 illustrates a schematic plan view discharge cell and sustain electrodes of FIG. 2.

The AC PDP 100 may include a first substrate 111, a second substrate 121, a plurality of pairs of sustain electrodes 112, a plurality of address electrodes 122, a plurality of barrier ribs 130, a protective layer 116, phosphor layers 126, a first dielectric layer 115, a second dielectric layer 125, and a discharge gas (not shown).

The first substrate 111 may be made of a material having excellent light transmission, e.g., mainly formed of glass. The first substrate 111 may be colored so as to reduce reflection brightness to improve contrast. In addition, the second substrate 121 may be separated from the first substrate 111 by a predetermined distance, so that the second substrate 121 is opposite to the first substrate 111. The second substrate 121 may also be made of a material having excellent light transmission, such as glass. The second substrate 121 may also be colored. Visible light emitted from the red, green, and blue discharge cells 170R, 170G, and 170B may be emitted through the first substrate 111 and/or the second substrate 121. However, according to the current embodiment of the present invention, visible light emitted from the red, green, and blue discharge cells 170R, 170G, and 170B is transmitted through the first substrate 111.

The barrier ribs 130 may partition the red, green, and blue discharge cells 170R, 170G, and 170B, in which discharge occurs, and may be disposed between the first substrate 111 and the second substrate 121. The red, green, and blue discharge cells 170R, 170G, and 170B may be sequentially and repeatedly disposed along a direction (x-direction) in which the pairs of sustain electrodes 112 extend. The barrier ribs 130 may prevent optical and electrical cross-talk between the red, green, and blue discharge cells 170R, 170G, and 170B. The barrier ribs 130 may include a plurality of first barrier rib portions 130*a* disposed in a direction (y-direction) in which the address electrodes 122, described later, extend, and a plurality of second barrier rib portions 130*b* disposed in a direction (x-direction) in which the second barrier rib portions 130*b* intersect the first barrier rib portions 130*a*.

The first barrier rib portions 130*a* and the second barrier rib portions 130*b* may be formed so that the red, green, and blue discharge cells 170R, 170G, and 170B have rectangular cross-sections. The shape of the barrier ribs 130 is not limited to this, and if the barrier ribs 130 form a plurality of discharge spaces, the barrier ribs 130 may be barrier ribs having a variety of patterns, e.g., open-type barrier ribs such as stripes, and closed-type barrier ribs such as waffle, matrix, or delta. In addition, if closed-type barrier ribs are used, the cross-sections of the discharge spaces may have circular shapes, elliptical shapes or polygonal shapes, e.g., triangular or pentagonal shapes, as well as rectangular shapes.

The pairs of sustain electrodes 112 may be disposed to be parallel to each other and spaced apart by a predetermined distance on the first substrate 111. Each of the pairs of sustain electrodes 112 may include X-electrodes 180 and Y-electrodes 190. The X-electrodes 180 and the Y-electrodes 190 may generate a plasma discharge in the red, green, and blue discharge cells 170R, 170G, and 170B.

Each X-electrode 180 may include a first electrode portion 181, a second electrode portion 182, a third electrode portion 183, and a connection portion 184. Each Y-electrode 190 may include a first electrode portion 191, a second electrode portion 192, a third electrode portion 193, and a connection portion 194. The connection portion 184 of the X-electrode 180 and the connection portion 194 of the Y-electrode 190, respectively, may be disposed to correspond to the red, green, and blue discharge cells 170R, 170G, and 170B. Hereinafter, for explanatory convenience, the connection portions 184 of the X-electrodes 180 corresponding to the red, green, and blue discharge cells 170R, 170G, and 170B are referred to as a first connection portion 184R, a second connection portion 184G, and a third connection portion 184B, and the connection portions 194 of the Y-electrodes 190 corresponding to the red, green, and blue discharge cells 170R, 170G, and 170B are referred to as a first connection portion 194R, a second connection portion 194G, and a third connection portion 194B.

The first electrode portion 181, the second electrode portion 182, and the third electrode portion 183 of each X-electrode 180 may be separated from one another by a predetermined distance, may be disposed to be parallel to one another, and may extend in a direction (x-direction) in which they cross the address electrodes 122. The third electrode portion 183, the second electrode portion 182, and the first electrode portion 181 may be sequentially disposed close to respective centers of the red, green, and blue discharge cells 170R, 170G, and 170B.

In the exemplary embodiments illustrated, each X-electrode 180 includes three electrode portions 181, 182, and 183, but the present invention is not limited to this. That is, the X-electrodes 180 include a plurality of electrode portions and may include, e.g., two through four electrode portions.

The first, second, and third connection portions 184R, 184G, and 184B may be disposed to electrically connect the first electrode portion 181, the second electrode portion 182, and the third electrode portion 183. As described above, the first, second, and third connection portions 184R, 184G, and 184B of each X-electrode 180 may correspond to the red, green, and blue discharge cells 170R, 170G, and 170B, respectively, and may extend in a direction (y-direction) perpendicular to the first, second, and third electrodes 181, 182, and 183. However, the present invention is not limited to the above-described arrangement structure.

The first, second, and third electrode portions 181, 182, and 183, and the first, second, and third connection portions 184R, 184G and 184B of each X-electrode 180 may be formed of various conductive materials, e.g., metallic materials or ceramic materials. Examples of metallic materials may include Ag, Pt, Pd, Ni, or Cu, and examples of ceramic materials may include indium doped tin oxide (ITO) or antimony doped tin oxide (ATO). In addition, in order to increase the amount of emission of secondary electrons, the first, second, and third electrode portions 181, 182, and 183, and the first, second, and third connection portions 184R, 184G, and 184B of each X-electrode 180 may be formed of a material including carbon nanotubes (CNTs).

The first, second, and third electrode portions 181, 182, and 183 and the first, second, and third connection portions 184R, 184G, and 184B of each X-electrode 180 can also be formed in a single layer structure but may have a multi-layered structure. If the first, second, and third electrode portions 181, 182, and 183 and the first, second, and third connection portions 184R, 184G, and 184B of each X-electrode 180 have a multi-layered structure, each layer may be formed of different material.

To simplify a manufacturing process, the first, second, and third electrode portions 181, 182, and 183 and the first, second, and third connection portions 184R, 184G, and 184B of each X-electrode 180 may be integrated with one another. For example, each X-electrode 180 may be formed of a thick layer using a printing method using a photosensitive paste. Alternatively, each X-electrode 180 may be formed of a thin film using sputtering or evaporation. At this time, the first, second, and third electrode portions 181, 182, and 183 may be formed to have the same line width B, shown in FIG. 4. For example, line widths of the first, second, and third electrode portions 181, 182, and 183 may be about 20-150 μm.

The first, second, and third connection portions 184R, 184G, and 184B of each X-electrode 180 may have a variety of line widths. The first, second, and third connection portions 184R, 184G, and 184B of each X-electrode 180 may have line widths of about 20-60 μm. The line widths of the first, second, and third connection portions 184R, 184G, and 184B of each X-electrode 180 may be smaller than those of the first, second, and third electrode portions 181, 182, and 183 of each X-electrode 180. More specifically, the first, second, and third connection portions 184R, 184G, and 184B of each X-electrode 180 may be disposed along a middle portion of discharge cells, in which a discharge occurs frequently, and visible light emitted from the red, green, and blue discharge cells 170R, 170G, and 170B may be greatly shielded. Thus, line widths of the first, second, and third connection portions 184R, 184G, and 184B may be smaller than those of the first, second, and third electrode portions 181, 182, and 183 that contribute to a main discharge.

As described above, in order to reduce shielding of visible light, the first, second, and third connection portions 184R, 184G, and 184B may have small widths. However, when the widths of the first, second, and third connection portions 184R, 184G, and 184B are too small, it may be difficult to manufacture them. Thus, the first, second, and third connection portions 184R, 184G, and 184B may have a break therein, i.e., be discontinuous. Accordingly, only some, rather than all, of the first, second, and third connection portions 184R, 184G, and 184B may have reduced line widths.

In order to improve brightness and reduce defects caused by a discontinuity, a line width SG of the second connection portions 184G corresponding to the green discharge cells 170G may be smaller than line widths SR and SB of the first connection portions 184R and the third connection portions 184B, respectively. More specifically, brightness of visible light in the green discharge cells 170G is the highest. For example, when each X-electrode 180 and each Y-electrode 190 include the first, second, and third electrode portions 181, 182, and 183, and 191, 192, and 193, respectively, and do not include the first, second, and third connection portions 184R, 184G, and 184B and 194R, 194G, and 194B, respectively, peak brightness in red discharge cells is 350 cd/m$^2$, peak brightness in green discharge cells is 800 cd/m$^2$, and peak brightness in blue discharge cells is 120 cd/m$^2$. That is, the ratio of brightness in the green discharge cells 170G to the overall brightness is about 63%. Thus, in the PDP 10, brightness in the green discharge cells 170G is the highest.

In order to improve brightness in the green discharge cells 170G, the line width SG of the second connection portions 184G corresponding to the green discharge cells 170G may be smaller than the line widths SR and SB of the first connection portions 184R and the third connection portions 184B. When the line widths SR and SB of the first connection portions 184R and the third connection portions 184B are larger than the line width SG of the second connection portions 184G, defects caused by discontinuities may be reduced. In addition, the line width SR of the first connection portions 184R and the line width SB of the third connection portions 184B can be different. However, in order to simplify manufacture and improve color temperature, the line width SR of the first connection portions 184R and the line width SB of the third connection portions 184B may be substantially the same. For example, the line width SG of the second connection portions 184G may be about 20-35 μm, and the line width SR of the first connection portions 184R and the line width SB of the third connection portions 184B may be about 35-60 μm.

However, the present invention is not limited to having the line width SG of the second connection portions 184G be smaller than the line widths SR and SB of the first connection portions 184R and the third connection portions 184B. When brightness of visible light generated in the red discharge cells 170R or the blue discharge cells 170B is higher than brightness of visible light generated in other discharge cells, the width of connection portions corresponding to the discharge cells in which brightness is the highest may be the smallest.

As described above, each Y-electrode 190 may include a first electrode portion 191, a second electrode portion 192, a third electrode portion 193, and first, second, and third connection portions 194R, 194G, and 194B. The Y-electrode 190 may be symmetrical to the X-electrode 180 in each of the discharge cells 170, so as to perform a discharge uniformly. The structure, operation, and material of the first, second, and third electrode portions 191, 192, and 193, and the first, second, and third connection portions 194R, 194G, and 194B of each Y-electrode 190 may be similar to those of the first, second, and third electrode portions 181, 182, and 183, and the first, second, and third connection portions 184R, 184G, and 184B of each X-electrode 180, and thus will be omitted.

Light absorption layers 140 may be disposed between adjacent pairs of sustain electrodes 112. More specifically, the light absorption layers 140 may be disposed on the first substrate 111 corresponding to the second barrier rib portions 130*b*. The light absorption layers 140 may absorb incident visible light and reduce reflection brightness, thereby increasing contrast. The light absorption layers 140 may have a stripe shape. In addition, when the light absorption layers 140 are formed of the same material as the X-electrodes 180 and the Y-electrodes 190, since the light absorption layers 140 can be simultaneously formed in a process of forming the X-electrodes 180 and the Y-electrodes 190, a manufacturing process can be simplified. A line width C of the light absorption layers 140 may be about 50-200 μm.

The first dielectric layer 115 may be formed on the front substrate 111 to cover the X-electrodes 180 and the Y-electrodes 190. The first dielectric layer 115 may be formed of a dielectric substance that prevents electricity between the adjacent X-electrodes 180 and Y-electrodes 190 from being electrically shorted during discharge, may prevent positive ions or electrons from colliding with the X-electrodes 180 and the Y-electrodes 190, may prevent the X-electrodes 180 and the Y-electrodes 190 from being damaged, and may accumulate wall charges. The dielectric substance may be, e.g., PbO, $B_2O_3$, or $SiO_2$.

In addition as shown in FIGS. 2 and 3, the protective layer 116, e.g., a MgO layer, may be formed on the first dielectric layer 115. The protective layer 116 may prevent positive ions and electrons from colliding with the first dielectric layer 115 during discharge, thus protecting the first dielectric layer 115 from damage, may have good light transmission and may emit a large amount of secondary electrons during discharge. The protective layer 116 may be a thin film formed using sputtering or electron beam evaporation.

The address electrodes 122 may be disposed on the second substrate 121, opposite the first substrate 111. The address electrodes 122 may cross the X-electrodes 180 and the Y-electrodes 190. The address electrodes 122 may be used to generate an address discharge in order to perform a sustain discharge between the X-electrodes 180 and the Y-electrodes 190 more easily. More specifically, the address electrodes 122 may reduce a voltage required for the sustain discharge. The address discharge may occur between the Y-electrodes 190 and the address electrodes 122. When address discharge is terminated, positive ions are accumulated on the Y-electrodes 190 and electrons are accumulated on the X-electrodes 180, such that sustain discharge between the X-electrodes 180 and the Y-electrodes 190 is more easily performed.

The second dielectric layer 125 may be disposed on the rear substrate 121 and may cover the address electrodes 122. The second dielectric layer 125 may be formed of a dielectric substance that may prevent positive ions or electrons from colliding with the address electrodes 122 during discharge, may prevent the address electrodes 122 from being damaged and may induce accumulation of wall charges. The dielectric substance may be, e.g., PbO, $B_2O_3$, or $SiO_2$.

Phosphor layers 126 producing red, green, and blue light may be formed on the second dielectric layer 125 between the barrier ribs 130 and on side surfaces of the barrier ribs 130. The phosphor layers 126 may include components that emit visible light in response to ultraviolet (UV) light. The phosphor layers 126 formed in red discharge cells may include phosphor such as $Y(V,P)O_4$:Eu, the phosphor layers 126 formed in green discharge cells may include phosphor such as $Zn_2SiO_4$:Mn, and the phosphor layers 126 formed in blue discharge cells may include phosphor such as BAM:Eu.

A discharge gas, e.g., a mixture of neon (Ne) and xenon (Xe), may fill the discharge cells 170. The first and second substrates 111 and 121 may be sealed and secured using a sealing member, e.g., frit glass, formed at edges of the first and second substrates 111 and 121.

The operation of the PDP 100 having the above structure according to the present invention will now be described.

An address voltage may be applied between the address electrodes 122 and the Y-electrodes 190 so that an address discharge occurs. Discharge cells 170 in which a sustain discharge is to occur may be selected by the address discharge. After the address discharge, when a sustain voltage is applied between the X-electrodes 180 and the Y-electrodes 190 of the selected discharge cells 170, positive ions accumulated on the Y-electrodes 190 and electrons accumulated on the X-electrodes 180 collide with one another so that a sustain discharge occurs. Voltage pulses may be alternatively and repeatedly applied to the X-electrodes 180 and the Y-electrodes 190, resulting in continuous discharge. In the sustain discharge between the X-electrodes 180 and the Y-electrodes 190, a discharge gap between the third electrode portions 183 of the X-electrodes 180 and the third electrode portions 193 of the Y-electrodes 190 is narrowest, and a discharge starts in the discharge gap. The discharge is then spread to the second electrode portions 182 and 192, and the first electrode portions 181 and 191. In the sustain discharge, the first, second, and third connection portions 184R, 184G, and 184B of each X-electrode 180 may allow a discharge to be smoothly spread, and may allow a discharge between the third electrode portion 183 and the second electrode portion 182 of each X-electrode 180, and between the second electrode portion 182 and the first electrode portion 181 of each X-electrode 180 to occur. In addition, the first, second, and third connection portions 194R, 194G, and 194B of each Y-electrode 190 may allow a discharge to be smoothly spread and may allow a discharge between the third electrode 193 and the second electrode 192 of each Y-electrode 190 and between the second electrode portion 192 and the first electrode portion 191 of each Y-electrode 190 to occur.

When the energy level of the excited discharge gas during the sustain discharge drops, UV light is emitted. The UV rays excite the phosphor layers 126 in the discharge cells 170. When the energy level of the excited phosphor layers 126 drops, visible light is emitted, constituting an image.

The PDP according to the present invention may provide, e.g., the following effects. First, brightness of the PDP may be increased. Second, the probability of electrode discontinuity may be reduced. Third, sustain electrodes may be formed of the same material and integrated into a single unit, reducing cost and simplifying manufacture.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:
a first substrate;
a second substrate separated from the first substrate by a predetermined distance;
a plurality of discharge cells in which a discharge occurs, the plurality of discharge cells being between the first and second substrates; and
a plurality of pairs of sustain electrodes disposed between the first substrate and the second substrate, the pairs of sustain electrodes generating a discharge therebetween,
wherein each sustain electrode includes a plurality of electrode portions and connection portions electrically connecting the electrode portions, and line widths of the connection portions corresponding to discharge cells having a highest brightness among the discharge cells being smaller than line widths of the connection portions corresponding to other discharge cells, and the line widths of the connection portions are smaller than the line widths of the electrode portions.

2. The plasma display panel as claimed in claim 1, wherein the plurality of discharge cells include red, green and blue discharge cells, and line widths of the connection portions corresponding to the green discharge cells are smaller than the line widths of the connection portions corresponding to the red and blue discharge cells.

3. The plasma display panel as claimed in claim 2, wherein the line widths of the connection portions corresponding to the blue discharge cells are substantially the same as the line widths of the connection portions corresponding to the red discharge cells.

4. The plasma display panel as claimed in claim 1, wherein the line widths of the connection portions are about 20-60 μm.

5. The plasma display panel as claimed in claim 1, wherein the line widths of the connection portions corresponding to the discharge cells having the highest brightness are about 20-35 μm, and the line widths of the connection portions corresponding to other discharge cells are about 35-60 μm.

6. The plasma display panel as claimed in claim 1, wherein the line widths of the electrode portions are about 20-150 μm.

7. The plasma display panel as claimed in claim 1, wherein each connection portion of a sustain electrode corresponds to one of the plurality of discharge cells.

8. The plasma display panel as claimed in claim 7, wherein each connection portion is in a center of each discharge cell.

9. The plasma display panel as claimed in claim 1, wherein the electrode portions of each sustain electrode are parallel to one another.

10. The plasma display panel as claimed in claim 1, wherein each sustain electrode includes between two and four electrode portions that extend in one direction.

11. The plasma display panel as claimed in claim 1, wherein the connection portions and the electrode portions are perpendicular.

12. The plasma display panel as claimed in claim 1, wherein the electrode portions of each sustain electrode have substantially the same line widths.

13. The plasma display panel as claimed in claim 1, wherein the connection portions and the electrode portions of each sustain electrode are integrated into a single unit.

14. The plasma display panel as claimed in claim 1, wherein the sustain electrodes include a conductive metallic material or a conductive ceramic material.

15. The plasma display panel as claimed in claim 14, wherein the sustain electrodes include at least one of Ag, Pt, Pd, Ni, and Cu.

16. The plasma display panel as claimed in claim 14, wherein the sustain electrodes include at least one of indium doped tin oxide (ITO) and antimony doped tin oxide (ATO).

17. The plasma display panel as claimed in claim 1, wherein the sustain electrodes include carbon nanotubes (CNTs).

18. The plasma display panel as claimed in claim 1, further comprising light absorption layers adjacent discharge cells and extending parallel to the plurality of sustain electrode pairs, the light absorption layers being made of a same material as the sustain electrodes.

19. A method of forming a plasma display panel, the method comprising:
providing a first substrate;
providing a second substrate separated from the first substrate by a predetermined distance;
providing a plurality of discharge cells in which a discharge occurs between the first and second substrates; and
forming a plurality of pairs of sustain electrodes disposed between the first substrate and the second substrate,
forming each sustain electrode including forming a plurality of electrode portions and connection portions electrically connecting the electrode portions, line widths of the connection portions corresponding to discharge cells having a highest brightness among the discharge cells being smaller than line widths of the connection portions corresponding to other discharge cells, wherein the line widths of the connection portions are smaller than the line widths of the electrode portions.

* * * * *